US008835734B2

(12) United States Patent
Schmidt

(10) Patent No.: US 8,835,734 B2
(45) Date of Patent: Sep. 16, 2014

(54) ACOUSTICAL DEVICE FOR DRUM

(71) Applicant: Eric Schmidt, Wichita, KS (US)

(72) Inventor: Eric Schmidt, Wichita, KS (US)

( * ) Notice: Subject to any disclaimer, the term of this patent is extended or adjusted under 35 U.S.C. 154(b) by 18 days.

(21) Appl. No.: 13/775,819

(22) Filed: Feb. 25, 2013

(65) Prior Publication Data

US 2013/0239776 A1 Sep. 19, 2013

Related U.S. Application Data

(63) Continuation-in-part of application No. 12/986,781, filed on Jan. 7, 2011, now abandoned.

(60) Provisional application No. 61/295,074, filed on Jan. 14, 2010.

(51) Int. Cl.
*G10D 13/02* (2006.01)

(52) U.S. Cl.
CPC ..... *G10D 13/02* (2013.01); *G10D 13/021* (2013.01)
USPC ..... 84/411 R

(58) Field of Classification Search
USPC ..... 84/411 R
See application file for complete search history.

(56) References Cited

U.S. PATENT DOCUMENTS

| | | | | |
|---|---|---|---|---|
| 4,805,514 | A | 2/1989 | Billings | |
| 6,639,134 | B2 | 10/2003 | Schmidt | |
| 6,677,512 | B1 * | 1/2004 | Chen | 84/411 R |
| 7,074,992 | B2 | 7/2006 | Schmidt | |
| 7,582,820 | B2 | 9/2009 | Millender, Jr. et al. | |
| 7,659,469 | B2 * | 2/2010 | Belli | 84/411 R |
| 7,842,867 | B2 | 11/2010 | Schmidt | |
| 2010/0031802 | A1 | 2/2010 | Millender, Jr. et al. | |
| 2010/0037750 | A1 | 2/2010 | Millender, Jr. et al. | |

OTHER PUBLICATIONS

Select File History of U.S. Appl. No. 12/986,781, dated Jan. 27, 2012 through Aug. 24, 2012, 21 pages.

* cited by examiner

*Primary Examiner* — Christopher Uhlir
(74) *Attorney, Agent, or Firm* — Lathrop & Gage LLP

(57) ABSTRACT

Disclosed is a device which is designed to improve the accoustics of a drum. The device has two halves, and it attaches about a hole formed in the drum head. One or both halves have portions which can be flared to a variety of degrees, e.g., 90 degrees, 180 degrees, 360 degrees or more.

2 Claims, 5 Drawing Sheets

ACOUSTICAL DEVICE FOR DRUM

RELATED APPLICATIONS

This application is a continuation-in-part of U.S. patent application Ser. No. 12/986,781 filed Jan. 7, 2011, which claims the benefit of U.S. Provisional Application No. 61/295,074 filed Jan. 14, 2010, the contents of which are all herein incorporated by reference.

BACKGROUND

1. Field of the Invention

Generally the invention relates to devices which operate with musical drums to improve sound quality. More specifically, the invention relates to devices that affect the release of air from the body of the musical drum as well as the transmission of sound waves from the drum upon the striking of the drum head.

2. Description of the Related Art

Numerous processes exist in the prior art which tune or adjust the audio output from a drum arrangement. Some drums, for example, bass drums, typically operate with a resonating head which resonate upon the striking of the striking head of the drum. Initially, the resonate head vibrates because of a displacement of the air inside the drum chamber. Other vibration is transferred through the surrounding drum structure to the resonate head.

It is known to change the sound characteristics of a bass drum using a cylindrically-shaped insert. See, for example, U.S. Pat. No. 7,582,820 issued to Millender, Jr., et al. Millender uses his cylindrical insert to maximize the punch of the bass drum as well as minimize ringing. The device is inserted into a circular opening created in the resonate head of the drum.

In another patent, U.S. Pat. No. 6,700,044, issued to Bencomo, Jr., a removable blocking member is provided which allows the user to selectively restrict the passage of air through the resonate drum head or remove a cover to expose an aperture to change the acoustical characteristics.

DETAILED DESCRIPTION OF THE DRAWINGS

Figure 1:
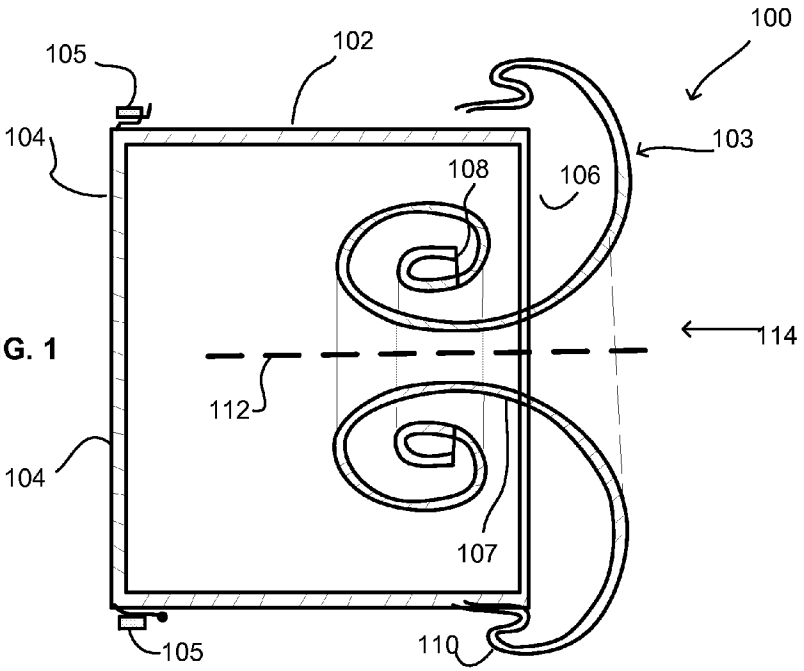
FIG. 1 shows a sectional view with a drum cut essentially front to back in half at the center axis for a first embodiment.

The details of the disclosed embodiments are shown in FIGS. 1-5. Referring first to FIG. 1, it can be seen that a drum system 100 is useable with a conventional bass drum. Although the drum used herein is a bass drum, these technologies could apply to other kinds of drums. As is common, the drum includes a substantially cylindrical body 102 which has front and rear ends. Normally the drum has two heads (one for striking, and another is referred to at the resonating, or resonate head). A striking head 104 is what receives an impact from a foot driven mallet device as is well known in the field. The striking head 104 is secured using a fastening mechanism 105 about the periphery of the forward part of the drum. At a second end 106 of the drum, where a resonate head exists, an alternative device 103 has been installed by adhering it to the outside of the drum body 102 at the rear end 106. Embodiment 103 is fixed to the outside surface of the drum body 102 at a connection point 110 using adhesive or fasteners or some other technique.

In this embodiment, device 103 is made to be symmetrical about a center axis 112 of the drum. A port 114 is defined through the center of the device 103 (also around the central axis 112). The port 114 opens up the inner drum chamber 109 through the rear of the drum. The device 103 and port 114 both have center axii which are the same as drum center axis 112. In other words, in this embodiment, all share the same axis. Alternatively, however, the axis for the device 103, port 114, could be offset in parallel, or even skewed from the center axis. Thus, the invention should not be limited to any particular embodiment depicted unless so stated in the claims.

Structurally, device 103 includes a body 107 which, describing it from rear to front, curves slightly out from connection edge 110, then tapers inward. Then the body 107 flares outward to such an extreme that it makes about one and a half curls to conclude with a termination edge 108 which is now internal to the body 107.

Figure 2:
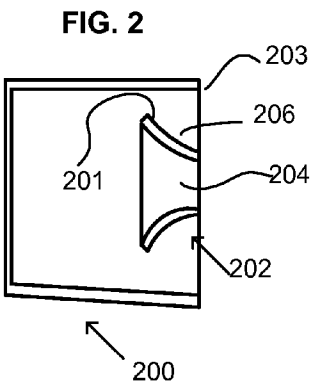
FIG. 2 shows a second sectional embodiment.

FIG. 2 shows an alternative second embodiment of the disclosed drum. In this embodiment, a system 200 comprises a device 202 which is mounted onto a resonate head 203 and has an port 204 defined through the resonate head 203. Resonant head could be formed of Mylar or an equivalent material. Again, device 202 shares a central axis which is common with the overall drum. As can be seen, the body 206 of device 202 is flared inward until reaching a terminating point 208. With this and other embodiments, the insert device 202 could be inserted and secured using an arrangement like that disclosed in the Millender patent discussed above. It could also be simply adhered around a removed circle in the resonant head, or include a peripheral channel which receive an inside edge of a circular cut out in the resonant head. Alternatively, it could be formed integrally with a resonate drum cover. For example, back cover 203 could be formed integrally with insert device 202.

Figure 3:
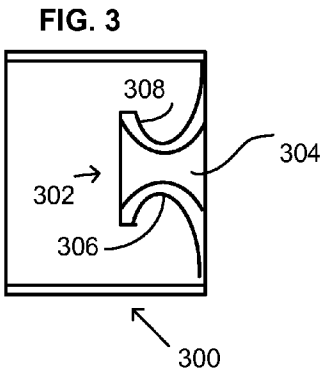
FIG. 3 shows a third sectional embodiment.

FIG. 3 discloses a third embodiment 300 which comprises a device 302 which takes the place of a resonate drum head like with the FIG. 1 embodiment. Again, insert 302 has the same center axis as the drum itself. Device 302 has a port 304 therethrough and, as can be seen in the Figure a body 306, which is flared first inward and then outward to a circular termination edge 308. Whereas FIG. 2 has a sort of trumpet configuration, this version flares both inward and outward once installed.

Figure 4:
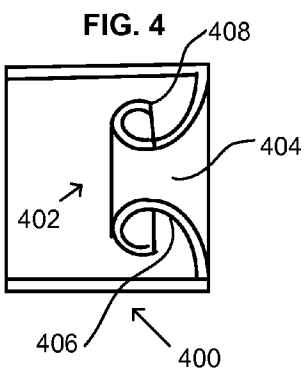
FIG. 4 shows a fourth sectional embodiment.

FIG. 4 shows a fourth alternative embodiment 400 in which a device 402 is attached to the back end of the drum instead of the traditional resonate drum head. As can be seen from FIG. 4, it also defines a port 404 therethrough which allows for the passage of air inward and outward. As can be seen in this embodiment, a body 406 is curved in even greater extent than that shown in FIG. 3, and a termination edge 408 is actually pointed towards the back end of the drum.

Figure 5:
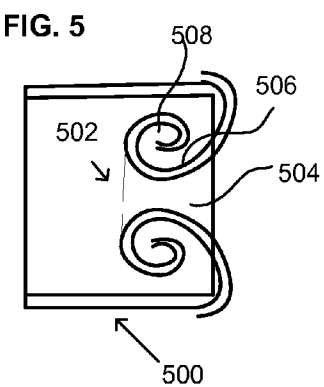
FIG. 5 shows a fifth sectional embodiment.
Figure 6:
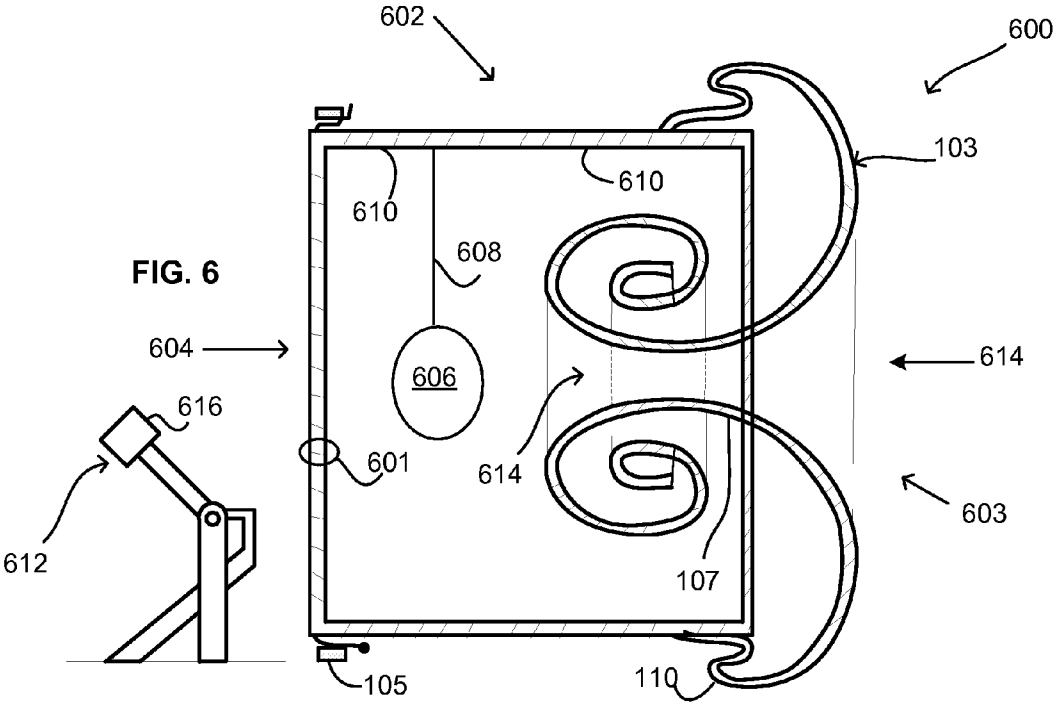
FIGS. 6-10 show embodiments which are very similar to the embodiments in FIGS. 1-5, except that a phase plug element is included.
Figure 10:
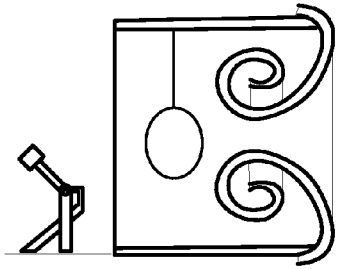
Figure 9:
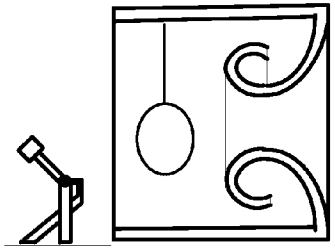
Figure 8:
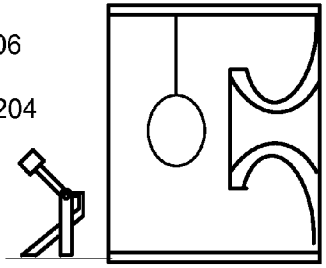
Figure 7:
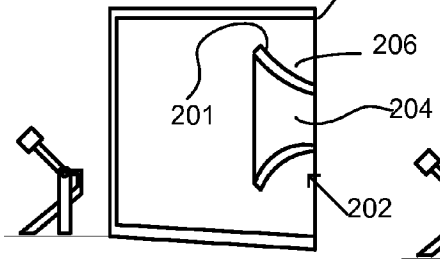

Referring now to FIG. 5, a fifth embodiment 500 is shown. Embodiment 500 includes a device 502 which is secured to the back end of the drum in the place of the resonance drum head. Device 502 includes a port. Like with all of the other prior embodiments, this device 502 has a central axis which is the same as the central axis for the drum itself. Although all of the embodiments in FIGS. 1-5 show arrangements in which the center axis of the port device (for example, devices 100, 200, 300, 400, 500), it should not be considered limiting that this is the case. It is certainly possible that alternative embodiments exist in which the device has an axis which is offset but parallel, or even skewed relative to the drum center axis.

It can be seen that a body 506 of the fifth embodiment is curled even to an extent greater than that shown in the FIGS. 2-4 embodiments, but less so than the FIG. 1 embodiment. Referring to the figure, it can be seen that body 506 tapers inward initially and then flares outward to such an extent that a termination edge 508 is pointing again in a forward direction relative to the drum. (Thus, one full curl once past the transition from tapering to flaring).

It has been shown the above configurations enhance the acoustics of the drum.

FIGS. 6-10 show embodiments in which occluding members are used to prevent direct which are very similar to the embodiments in FIGS. 1-5, except that a spherical phase plug element 606 is included. Referring to the FIG. 6 embodiment 600, it can be seen that interposed member 606 hangs from a string 608 or other suspension means. Alternatively it could be positioned using some securing or supporting arrangement. Member 606, in the disclosed embodiment, is positioned directly between the strike zone 601 on the forward head of the drum, and the port 614 of the insert 603. More specifically, in the disclosed embodiment, the center of member 606 is in the line between zone 601 where head 616 of the striker impacts, and the center axis of port 614. It is believed that the positioning of member 606 blocks the directional high frequency "tick" or "click" from the striker, and thus damps these undesirable sounds. By obstructing the direct line-of-audio transmission between the drum strikes and the phase plug 614, the audio of the drum is improved.

Although the interposed members (e.g., member 606) in each of FIGS. 6-10 is spherical, it might instead be shaped in numerous other ways so long as it is between the striked portion of the striker head and the rear end of the drum.

Figure 11:
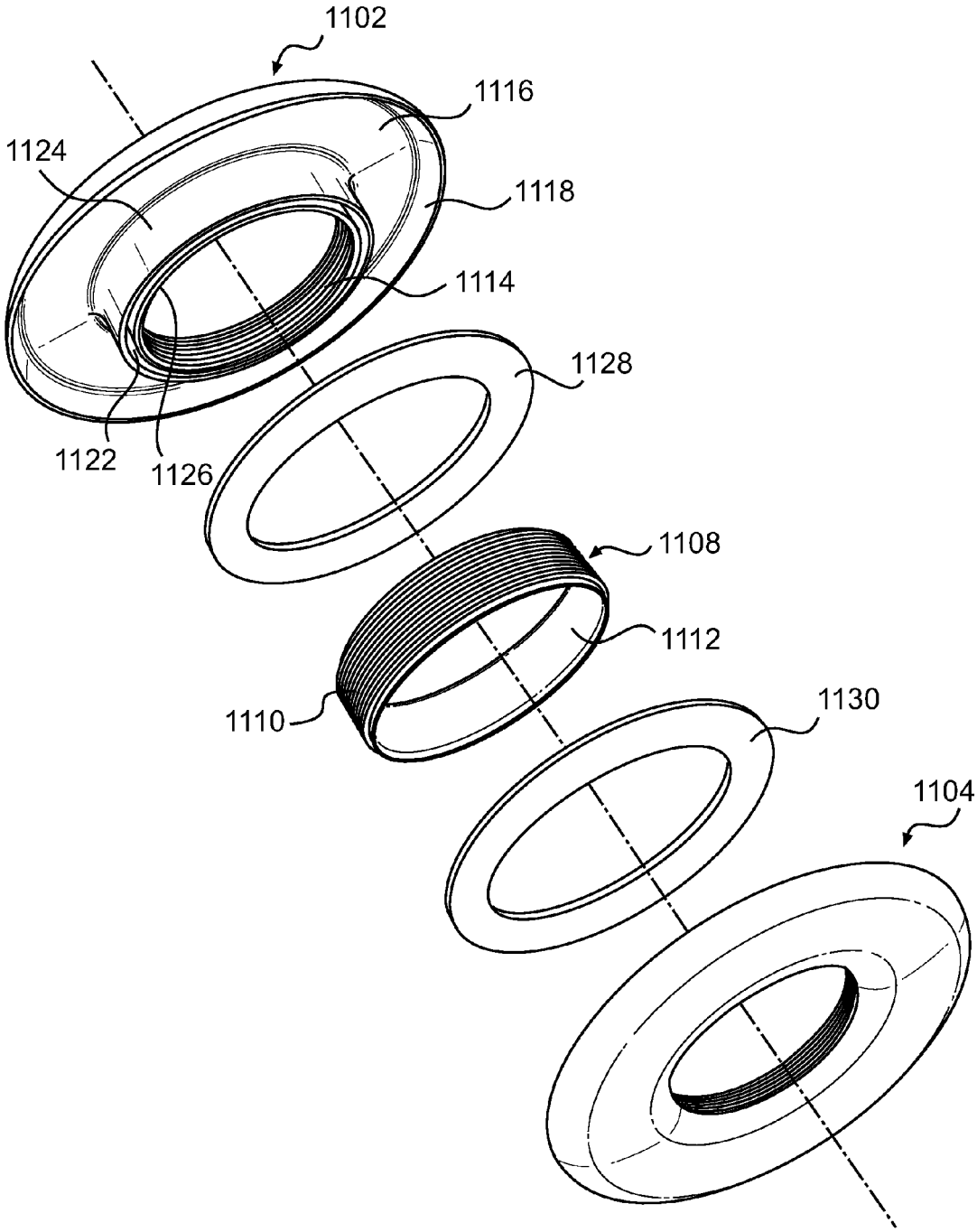
FIGS. 11-13 show yet another embodiment.
Figure 12:
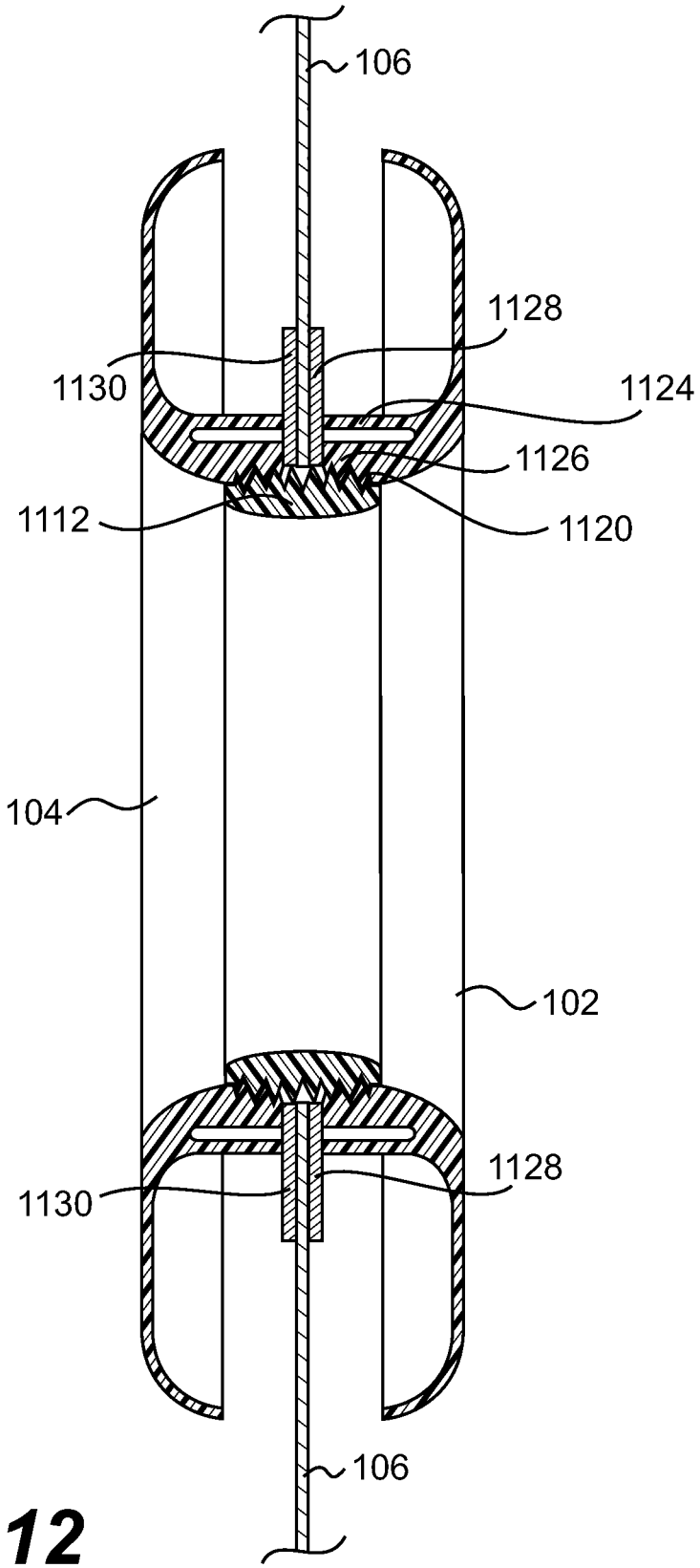
Figure 13:
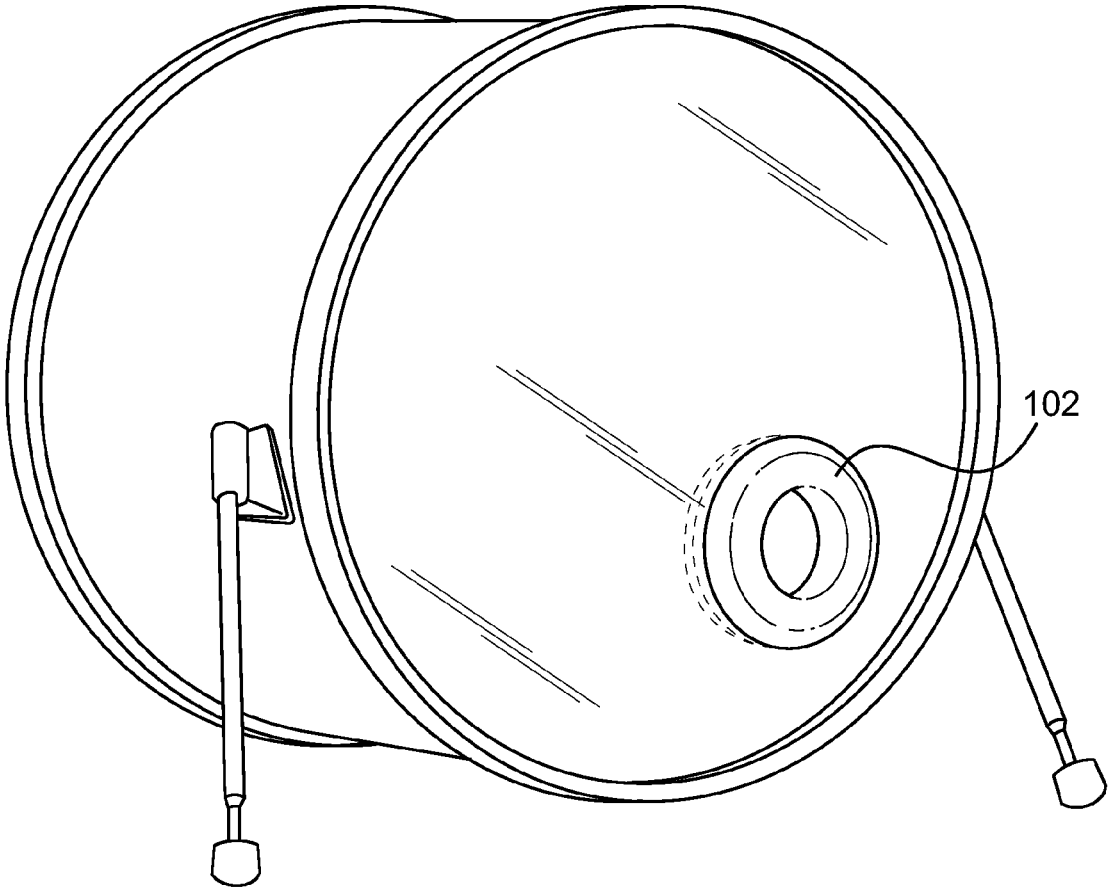

In the embodiment shown in FIGS. 11-13, a five-piece system is used. An outwardly flared portion 1102 and an inwardly flared portion 1104 are held on either side of a drumhead 1106 by an outwardly threaded joining portion 1108.

Referring first to the joining portion 1108, it is generally cylindrical, and has threads 1110 on its outer surfaces, and a smooth interior surface 1112. Both the outwardly flared portion 1102 and the inwardly flared portion 1104 are substantially identical. The outwardly flared portion 1102 has an inward portion 1120 which has interior threads 1114 which will mate with the outer threads 1110 on the joining portion 1108 as will be discussed hereinafter. The outwardly flared portion 1102 also includes a flared portion 1116 which is substantially flat at its outward-most surface 1117, and then has an edge 1118 which turns inwardly and then terminates in a direction facing inward. The threaded-inward-cylindrical portion 1120 is located coaxially inward of an outward clamping portion 1124 and the two are separated by a coaxial channel 1122 (or opening). Both the inward portion 1120 and the outward portion 1124 have engaging edges 1126 and 1127, respectively. These edges will clamp down on a soft flexible damping washer 1128 the drumhead hole edges as will be discussed hereinafter. Opposing edges (not shown) exist on symmetrical opposing inwardly flared half 1104, and will engage a second washer 1130 from the opposite side. Thus, both of these washers sandwich the drumhead 106 as shown in FIG. 12.

Since it is symmetrical to the outward flared portion 1102, the inwardly flared portion 1104 is substantially identical thereto, and operates in the same manner from an opposite orientation. It also has an inward threaded cylindrical portion, a flare portion turning into a substantially flat outward-most portion, and then curving inwards at an edge. Also like the other half, it has a drumhead clamping edges formed on threaded and outer coaxial portions.

Installation of the system is made very easy. First, a hole should be cut in the drumhead. More specifically, the hole cut in the drumhead should have a diameter that is slightly greater than the diameter (from the center axis of each flared portion) that is equal to the diameter of extending from the center axis to the clamping edges of the halves (e.g., 1126 and 1127 on half 1102, and the opposing clamping edges on the symmetrical and opposite half 1104). Once the hole is cut, it is normally good practice to screw the joining portion into one of the two halves, and then place the washer on the joining portion. Since the two halves are substantially identical, it makes little difference which one is used first. Then, the joining portion is slid into the hole, leaving the flared portion (already installed) on the outside of the drumhead, and mashing the one washer between the portions 1124 and 1126. Then, now that half the threads on connector 1108 are exposed on the opposite side of the drum head, the second washer 1130 can be slid over it. Next, the other half is screwed on to the joining portion so that it sticks out from the opposite side of the drumhead, and the inner portions of it mash both washers together against the drum head as shown in FIG. 12. The result is the end product you see in its installed condition as shown in FIG. 13.

As can be seen, the present invention and its equivalents are well-adapted to provide a new and useful drum. Many different arrangements of the various components depicted, as well as components not shown, are possible without departing from the spirit and scope of the present invention.

The present invention has been described in relation to particular embodiments, which are intended in all respects to be illustrative rather than restrictive. Alternative embodiments will become apparent to those skilled in the art that do not depart from its scope. Many alternative embodiments exist but are not included because of the nature of this invention. A skilled programmer may develop alternative means of implementing the aforementioned improvements without departing from the scope of the present invention.

It will also be understood that certain features and subcombinations are of utility and may be employed without reference to other features and subcombinations and are contemplated within the scope of the claims. Not all steps listed in the various figures need be carried out in the specific order described.

I claim:

1. A device for changing an acoustic effect of a drum, the drum having a drumhead, the device comprising:

an outwardly flared portion;

an inwardly flared portion;

a substantially cylindrical outwardly threaded joining portion, the joining portion being receivable through a hole defined in the drumhead, the hole having an edge, the outwardly flared and inwardly flared portions being screwable onto the joining portion from opposite sides of the drumhead to clamp down onto the drumhead around the hole.

2. The device of claim 1 wherein a first washer is provided which is received between the outwardly flared portion and a first side of the edge of the hole, and a second washer is received between the inwardly flared portion and an opposite side of the edge of the hole, and when the outwardly flared and inwardly flared portions are screwed onto the joining portion, the first and second washers are sandwiched between the flared portions and the drumhead.

* * * * *